US010854119B2

(12) United States Patent
Entwistle

(10) Patent No.: US 10,854,119 B2
(45) Date of Patent: Dec. 1, 2020

(54) DISPLAY UNIT

(71) Applicant: Urben Technologies Limited, St. Albans (GB)

(72) Inventor: Michael Entwistle, St. Albans (GB)

(73) Assignee: URBEN TECHNOLOGIES LIMITED, St. Albans (GB)

( * ) Notice: Subject to any disclaimer, the term of this patent is extended or adjusted under 35 U.S.C. 154(b) by 0 days.

(21) Appl. No.: 16/099,060

(22) PCT Filed: Apr. 28, 2017

(86) PCT No.: PCT/GB2017/051214
§ 371 (c)(1),
(2) Date: Nov. 5, 2018

(87) PCT Pub. No.: WO2017/191440
PCT Pub. Date: Nov. 9, 2017

(65) Prior Publication Data

US 2019/0180656 A1 Jun. 13, 2019

(30) Foreign Application Priority Data

May 6, 2016 (GB) ..... 1607975.8

(51) Int. Cl.
*G09F 7/18* (2006.01)
*G09F 15/00* (2006.01)
(Continued)

(52) U.S. Cl.
CPC ..... *G09F 15/0012* (2013.01); *G09F 7/10* (2013.01); *G09F 7/18* (2013.01); *G09F 9/30* (2013.01);
(Continued)

(58) Field of Classification Search
CPC ..... E04B 2/7809; E04B 2/7818; E04B 2/789; E04B 2/76; E04B 2001/2481;
(Continued)

(56) References Cited

U.S. PATENT DOCUMENTS 4,630,386 A * 12/1986 Wilson ..... A47G 1/0605 40/734
4,907,388 A * 3/1990 Siahatgar ..... E04B 2/744 52/481.2
(Continued)

FOREIGN PATENT DOCUMENTS

CN 2431388 Y 5/2001
CN 101025875 A 8/2007
(Continued)

OTHER PUBLICATIONS

Search Report under Section 17(5) for United Kingdom Patent Application No. GB1607975.8 dated Nov. 7, 2016, 4 pages.
(Continued)

*Primary Examiner* — Cassandra Davis
(74) *Attorney, Agent, or Firm* — Withrow & Terranova, P.L.L.C.

(57) ABSTRACT

A display unit comprising one or more display panels (5*a*) and a peripheral frame (2) in which the one or more display panels are mounted and by which the one or more display panels are supported, wherein the peripheral frame comprises a plurality of straight extruded sections (3*a*-3*d*) and a plurality of corner sections (4*a*-4*d*) linking the straight extruded sections together to form the peripheral frame, each straight extruded section having a substantially solid body defining a substantially flat and inflexible inward facing surface, in which surface a plurality of transversely spaced extruded channels are formed running longitudinally in a length direction of the straight extruded section, each channel in profile having a narrow neck portion and a wider main
(Continued)

portion below the neck portion, the display unit further comprising a plurality of channel engaging members each arranged to be slotted into any one of the extruded channels to permit each channel engaging members to be placed in any desired transversely spaced channel and to slide along that channel to a desired longitudinal position, to anchor a mounting for a component of the display unit again the substantially flat and inflexible inward facing surface at one or more transverse locations.

18 Claims, 9 Drawing Sheets

(51) Int. Cl.
*G09F 9/30* (2006.01)
*G09F 27/00* (2006.01)
*G09F 7/10* (2006.01)

(52) U.S. Cl.
CPC ..... *G09F 15/0018* (2013.01); *G09F 27/00* (2013.01)

(58) Field of Classification Search
CPC ..... E04B 2001/2475; E04B 2001/405; E09B 2/60; G09F 15/0012; G09F 15/0018; G09F 7/18; G09F 7/10; G09F 27/00; G09F 9/30; G09F 9/3026; G09G 2300/026; G06F 3/1446; G02F 1/13336
See application file for complete search history.

(56) References Cited

U.S. PATENT DOCUMENTS

| | | | | |
|---|---|---|---|---|
| 5,377,434 | A | 1/1995 | Wilson | |
| 6,141,926 | A * | 11/2000 | Rossiter | E04B 2/7425 160/135 |
| 6,279,278 | B1 * | 8/2001 | Morris | E04B 2/7422 52/238.1 |
| 8,365,449 | B2 * | 2/2013 | Gimpel | G09F 13/04 160/351 |
| 9,549,482 | B2 * | 1/2017 | Podemski | H05K 7/02 |
| 2006/0227003 | A1 | 10/2006 | Ven | |
| 2008/0074349 | A1 | 3/2008 | Hong | |
| 2008/0259573 | A1 | 10/2008 | Besserer et al. | |
| 2011/0069471 | A1 | 3/2011 | Higson | |
| 2014/0208626 | A1 | 7/2014 | Moon | |
| 2019/0367263 | A1 * | 12/2019 | Chabot | B65D 7/24 |

FOREIGN PATENT DOCUMENTS

| | | | |
|---|---|---|---|
| CN | 101150942 | A | 3/2008 |
| CN | 101208733 | A | 6/2008 |
| CN | 103108146 | A | 5/2013 |
| CN | 103422798 | A | 12/2013 |
| DE | 20001923 | U1 | 5/2000 |
| EP | 2230659 | A1 | 9/2010 |
| GB | 2254551 | A | 10/1992 |
| JP | 2011066420 | A | 3/2011 |
| KR | 20090107741 | A | 10/2009 |
| KR | 20110001438 | A | 1/2011 |
| WO | 9009620 | A | 8/1990 |
| WO | 2008119142 | A2 | 10/2008 |

OTHER PUBLICATIONS

International Search Report and Written Opinion for International Patent Application No. PCT/GB2017/051214, dated Aug. 2, 2017, 15 pages.
Search Report for Chinese Patent Application No. 201780028086.0, dated Jul. 8, 2020, 3 pages.
First Office Action for Chinese Patent Application No. 201780028086.0, dated Jul. 16, 2020, 20 pages.

* cited by examiner

DISPLAY UNIT

This application is a 35 U.S.C. § 371 national phase filing of International Application No. PCT/GB2017/051214 filed on Apr. 28, 2017, and claims the benefit of United Kingdom Patent Application No. 1607975.8 filed on May 6, 2016, wherein the entire disclosures of International Application No. PCT/GB2017/051214 and United Kingdom Patent Application No. 1607975.8 are hereby incorporated by reference herein in their respective entireties.

The present invention relates to a display unit and particularly, but not exclusively, to a standalone display unit capable of housing ancillary equipment, such as associated computers, communication equipment, sound equipment or the like. The invention may be particularly applicable to a freestanding display unit, or at least a display unit which is capable of being freestanding.

There is a requirement, particularly in the corporate market, to have ever larger displays which may comprise different display panels or display boards, for example multiple flat panel displays, interlinked flat panel displays to function as one display or combinations of different display types, such as flat panel displays and interactive whiteboards for example. These will normally require to be adjacent one another and these will typically require a significant quantity of associated components, such as computers and communication devices, which are often discreetly housed adjacent to the displays. Alternatively, appropriate cabling may be provided between the display and remotely located ancillary equipment.

At present, relatively large displays may be constructed on site and may be secured to a frame mounted on a convenient wall, which in some cases may be a purpose built partition or dummy wall. Alternatively they may be built on a frame which is arranged not to be visible from behind the display.

An advantage of the above type of displays is that they can be configured to a specific requirement.

A disadvantage of such displays is that they are relatively permanent and thus it is difficult to move them from one location to another. They also often require a conventional wall or partition to which they may be secured, making it difficult to install them in many locations in modern open plan offices, or even partitioned areas, particularly if the partitions are glass partitions.

As an alternative to the above type of displays, there are available a number of self-contained display units which can be mounted on a wall or a stand. However, these are typically "off the shelf" units and cannot easily be manufactured to a specific customer's requirements or be reconfigured.

According to the present invention, there is provided a display unit comprising one or more display panels and a peripheral frame in which the one or more display panels are mounted and by which the one or more display panels are supported, wherein the peripheral frame comprises a plurality of straight extruded sections and a plurality of corner sections linking the straight extruded sections together to form the peripheral frame, each straight extruded section having an outer outward facing face and an inner inward facing face, the inward facing face having a plurality of spaced channels running longitudinally in a length direction of the straight extruded section, each channel in profile having a narrow neck portion and a wider main portion below the neck portion, the display unit further comprising a plurality of channel engaging members each arranged to be slotted into the extruded channels to permit each channel engaging members to be placed in a desired channel and to slide along that channel to a desired location, to anchor a mounting for a component for a component of the display unit.

A display unit in accordance with the present invention provides a unit where the peripheral frame may both provide an aesthetically pleasing housing for the various components of the display and also support those components in a manner which enables the display unit to be configured to a particular requirement. It may also permit the display unit to be assembled relatively easily using multiple common components and for the display unit to then be either mounted to a wall, stood against a wall or to be left freestanding, possibly with the aid of small stabilising legs or feet. This makes it convenient to "temporarily" install a display unit, for example at an exhibition or a conference, or to install it at any convenient location, for example across a corner of a room or against a glass partition, without the need to provide a false wall or the like on which to mount it.

All the above may be possible with the present invention by the peripheral frame both housing and supporting the display panels and ancillary components. This not only provides a neat structure in which any required computers or ancillary equipment can be housed, reducing to a minimum any external cabling, but the frame supporting the components within it enables the display unit to be freestanding or relatively simply mounted to a wall, for it is only necessary for the peripheral frame to be supported, either by standing on the floor or by being connected to an appropriate mounting on a wall.

With the present invention the components of the display unit, including the display panels, (which may be any type of visual display unit or visual display board), may be relatively easily configured within a frame constructed of only two basic component types. Furthermore, the peripheral frame enables the various components, such as speakers or rack mount pods for storing computers or communication equipment, to be mounted at any desired location within the peripheral frame. Also, because the peripheral frame may be constructed from only two component types, (straight extruded section and corner sections) a selection of components, for example one, two or three flat panel displays may be selected for a particular requirement and straight extruded section then cut to appropriate lengths to make the display unit the correct length to house the selected display panels. Other appropriate components, such as speakers or blanking panels, may then be selected both as necessary and to completed the display unit, to provide a compact aesthetically pleasing unit.

Preferably each straight extruded section has a substantially U-shaped cross section, with a substantially flat base portion and two side portions, wherein the inner face of the base portion has at least two extruded channel in it. The U-shaped cross section may both provide the display unit with a particularly pleasing aesthetic form, for example it may have bevelled outer edges and it may also enhance the rigidity of the peripheral frame. It may also permit flat panel displays or blanking panels to directly abut the edge of the peripheral frame, whilst still leaving a limited space for any mounting for attaching components to the extruded channels in the base portion of the straight extruded sections.

The provision of at least two extruded channels on the inner face of the base portion either enables a mounting for a component to be anchored at multiple transverses locations, at any position along the frame, or permits a mounting for a component to be anchored at a selected one of multiple transverse locations at any position along the straight extruded section. Three or more channels may be formed in the flat base portion of the straight extruded section.

Advantageously at least one and more preferably both of the inner faces of the side portions of the straight extruded sections have at least one channel therein. This may provide a particularly stable anchorage if a mounting for a component is anchored in both a channel in the inner face of the side portion and a channel in the inner face of the base portion, which channels, in profile, may be arranged perpendicular to each other.

Alternatively a channel in the inner face of the side portion may provide a convenient anchorage for a mounting for a component which is to be mounted flush with a front edge of the peripheral frame.

Advantageously each corner section has a cross sectional profile having channels corresponding to the channels in the straight extruded sections, which channels are in register with the channels in the straight extruded sections when the peripheral frame is assembled. In this manner the channels in the straight extruded sections effectively extend through the corner sections, which corner sections may be formed from the same extruded section as the straight extruded sections, but which is curved.

The continuous channels through the corner sections both enables the said engaging members to be used to fix components to the corner sections and also enables the engaging members, if captive within the channels, to be slid from one extruded straight section to another extruded straight section, possibly with appropriate mountings for components already attached. This may be advantageous for appropriate mountings may be pre-assembled on one or more straight extruded sections and then these may be slid to an appropriate position once the peripheral frame has been assembled.

The straight extruded sections and corner sections, in cross section, may have a plurality of corresponding sets of holes for receiving respective dowels when the peripheral frame is assembled. This provides a convenient way of ensuring adjacent sections of the peripheral frame are in register and provides a strong joint between adjacent sections of the peripheral frame. It may also permit a bracing corner member to be used to connect the ends of adjacent extruded straight sections with a turnbuckle anchored at one end midway along the bracing section and at the other end to a respective corner section, to draw the corner section into the two straight extruded sections, thereby locking the sections together and bracing the corner at 90°, or at some other desired angle depending on the geometry of the corner section.

The channel engaging members may be T-slot nuts, which may be inserted into the channels and slid to a desired location.

In a simple form the peripheral frame may comprise four right angled corner sections and four extruded straight sections which together may make a square or rectangular peripheral frame.

The display unit may comprise at least one planar section with parallel front and rear faces wherein the peripheral frame forms a continuous edge around the planar section. This may provide a particularly pleasing appearance to the display unit.

The display unit may comprise two or more planar sections wherein at least two planar sections are angled relative to each other and wherein the peripheral frame is continuous about all the planar sections. An advantage of this arrangement is that display unit can be built to be freestanding because the angle between the two or more planar sections will maintain the display unit in an upright position. Where the peripheral frame comprises two adjacent straight extruded sections of these may be mitred where the two respective planar sections meet.

The peripheral frame is preferably continuous extending around the complete periphery of the display unit, for this will greatly increase the robustness of the peripheral frame.

Advantageously the display unit comprises a plurality of components of different types to be housed in and supported by said peripheral frame and a plurality of different types of mountings arranged to engage with the channel engaging members in appropriate channels and at appropriate locations along the channels to permit the different component types to be correctly located.

The display unit may comprise a plurality of internal frame members for supporting one or more display panels or other components within the peripheral frame, each internal frame member being arranged to be supported by and retained in place by the peripheral frame and arranged to engage, via appropriate mountings, with the channels in the peripheral frame. This permits components to extend, for example, halfway across the display unit and to be anchored at one edge to an internal frame member in the middle of the display unit, whilst still being supported by the peripheral frame by virtue of the frame member being supported by the peripheral frame.

Where there are internal frame members, these are preferably extruded and have extruded channels having the same cross section profile as the extruded channels in the peripheral frame. This permits the same channel engaging members, for example T-slot nuts, to be used with the internal frame members as are used with the peripheral frame and thus may also permit the same mountings to be used.

Advantageously the display unit may comprise a plurality of different types of components to be mounted in the display unit and a plurality of identical mountings arranged to engage with the channel engaging members to provide mountings for the components, wherein identical mountings may be used to mount different types of components to the peripheral frame. This standardisation of mountings and components makes it a relatively simple matter to reconfigure the display unit, or to build a particular display unit from standard components and mountings.

According to a second aspect of the present invention there is provided a display unit system comprising a number of identical display panels, straight extruded sections, corner sections and other sets of identical components, all arranged to be assembled into different display unit configurations as described above.

Several embodiments of the present invention will now be described, by way of example only, with reference to the accompanying drawings of which;

Figure 5:
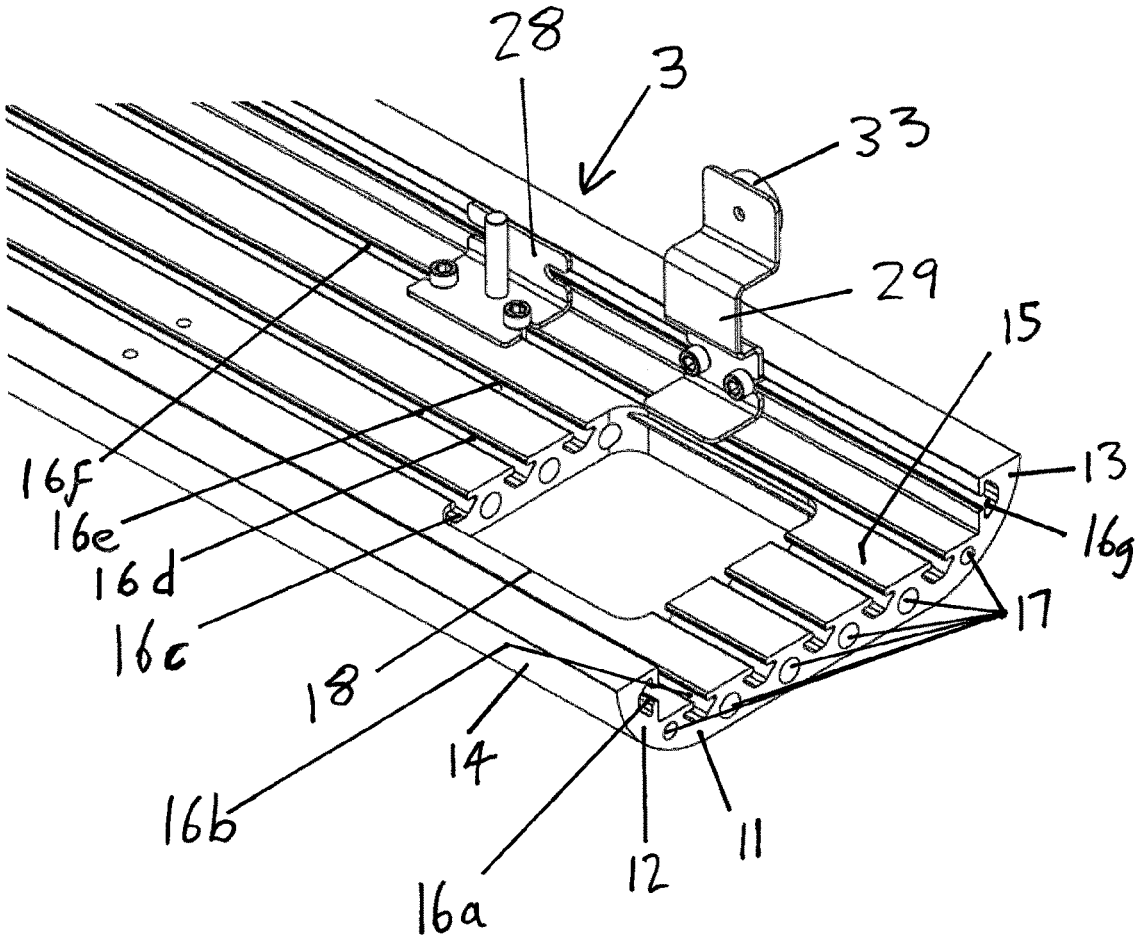
Figure 6:
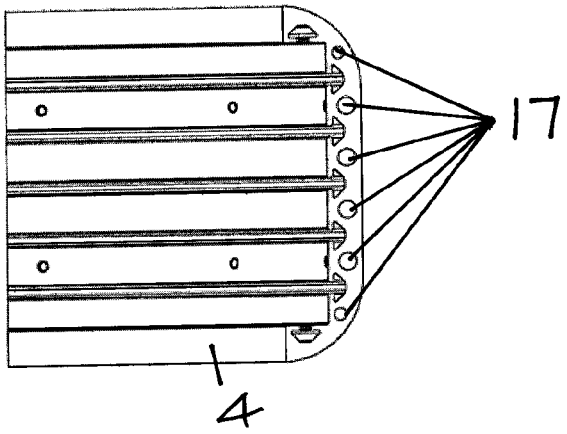
Figure 7:
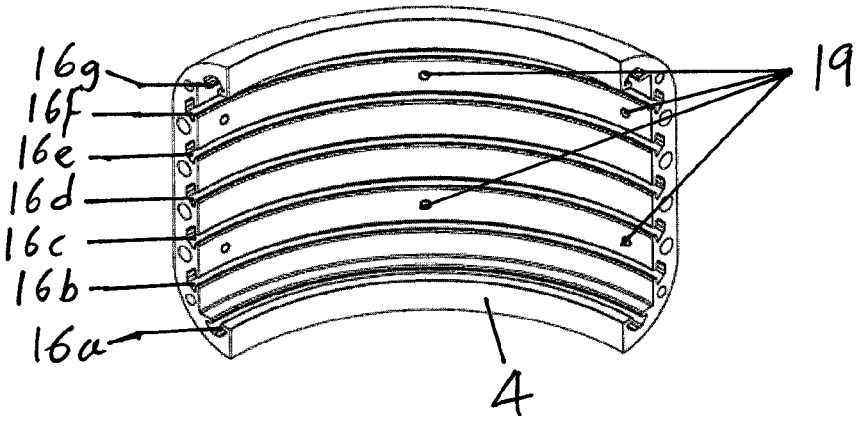
Figure 8:
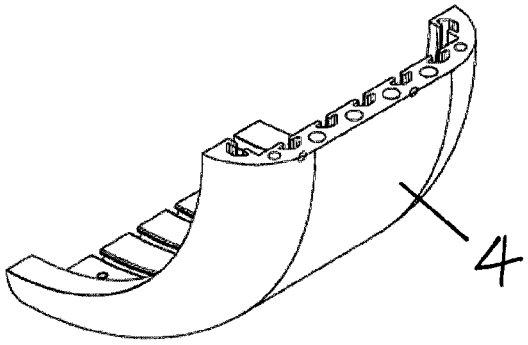
Figure 9:
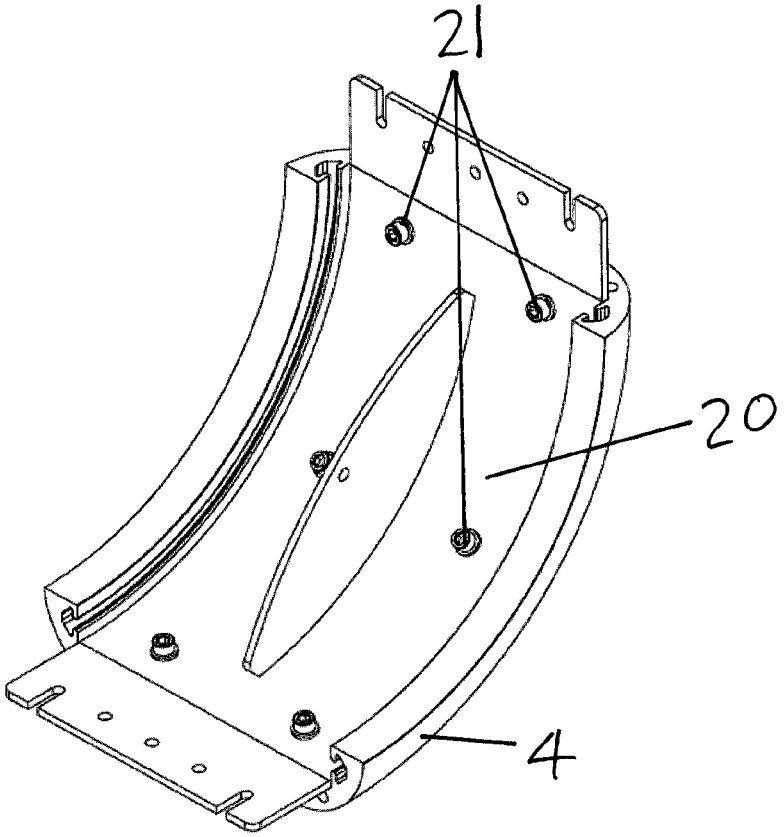
Figure 10:
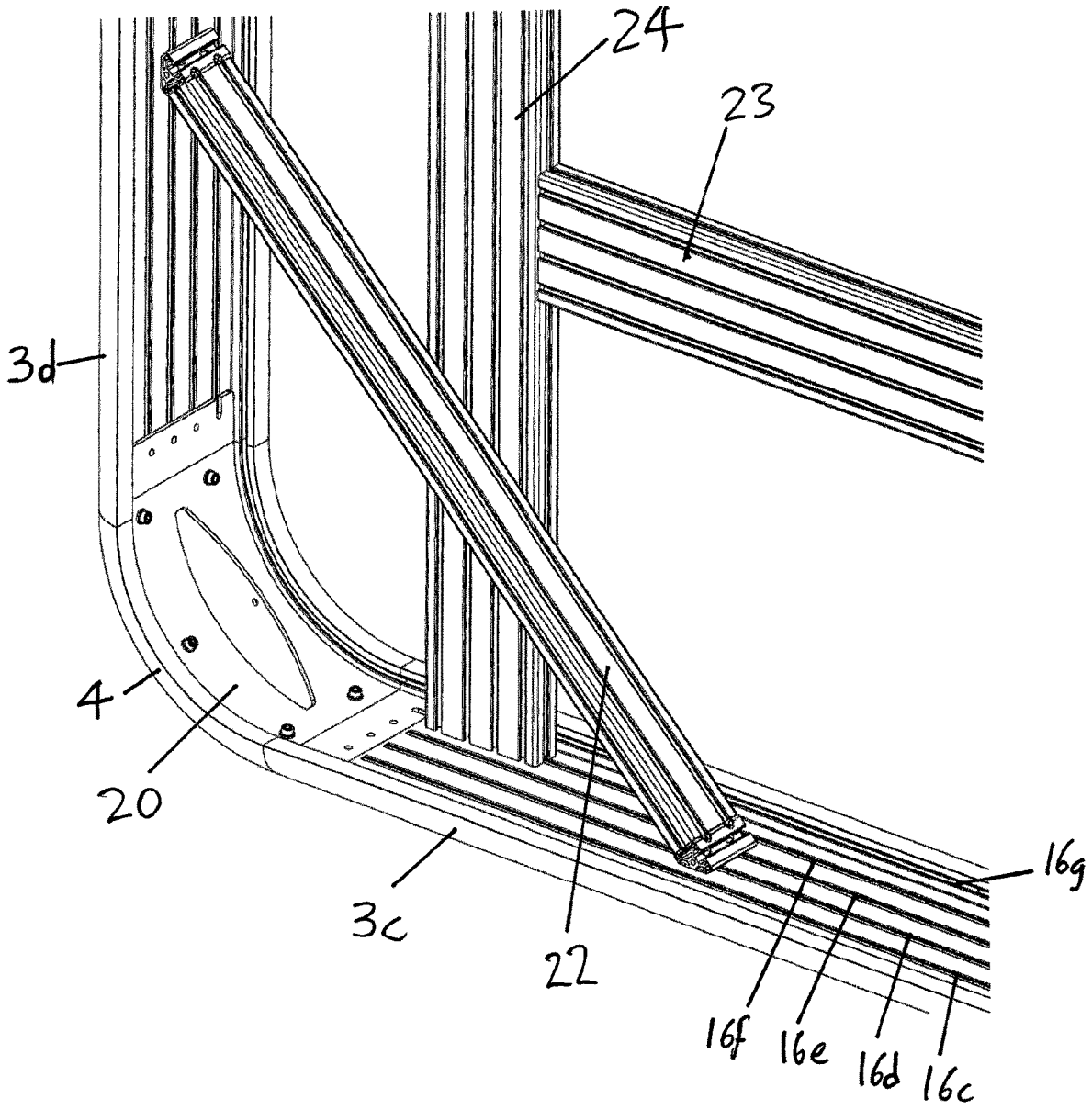
Figure 11:
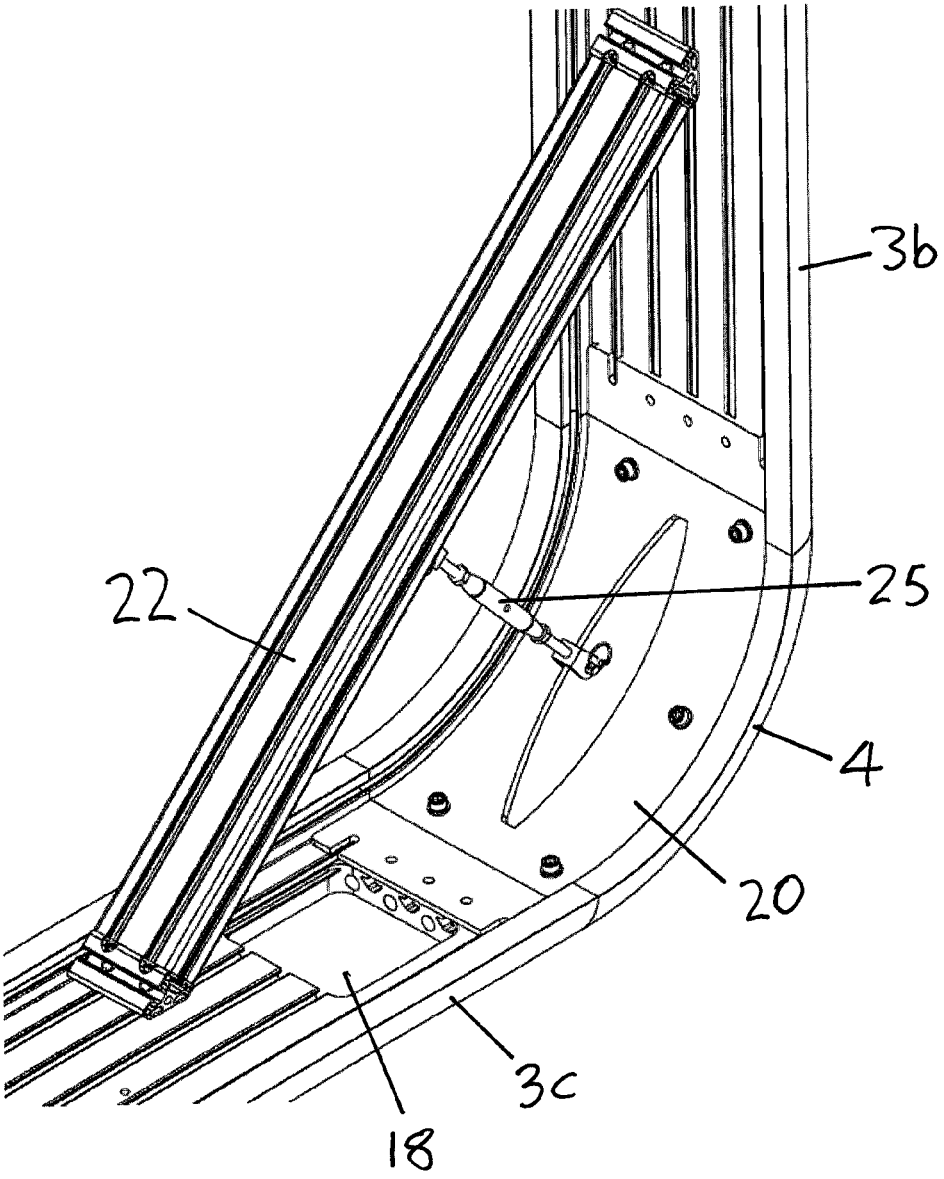
Figure 12:
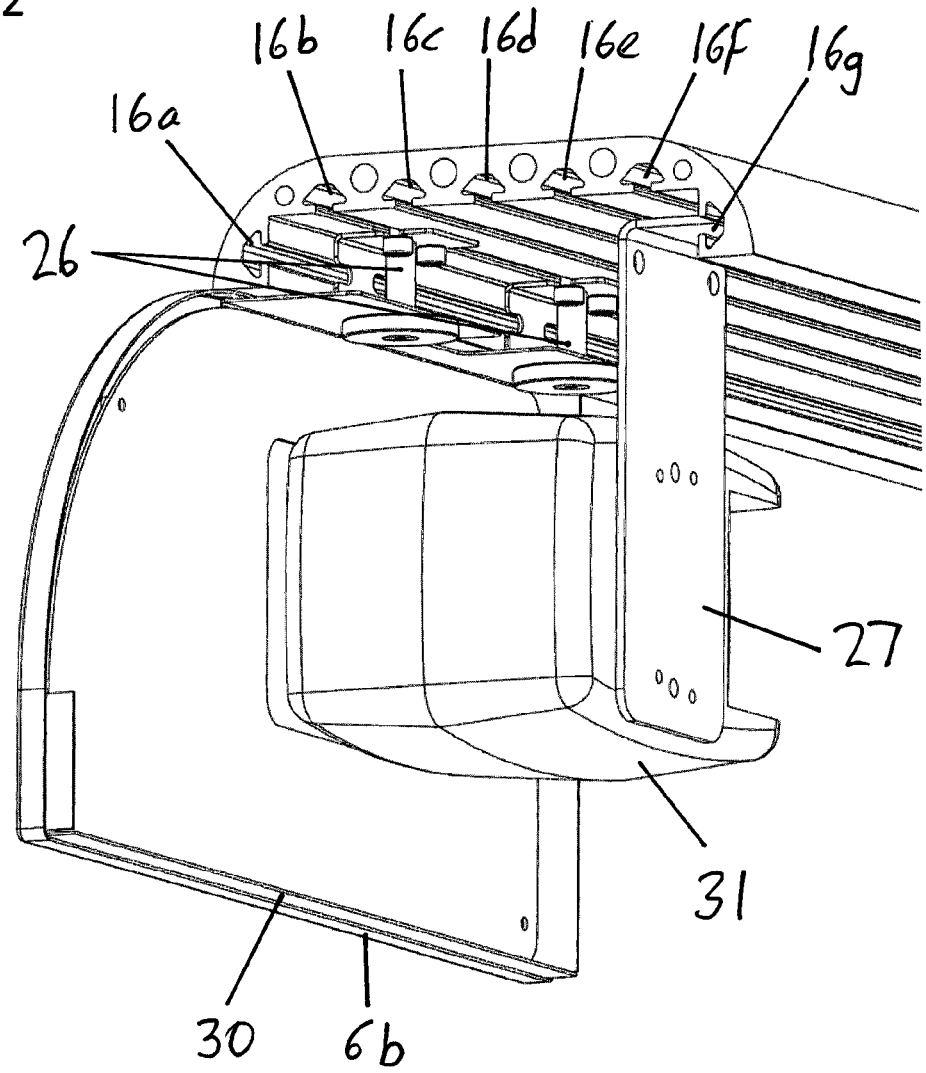
Figure 13:
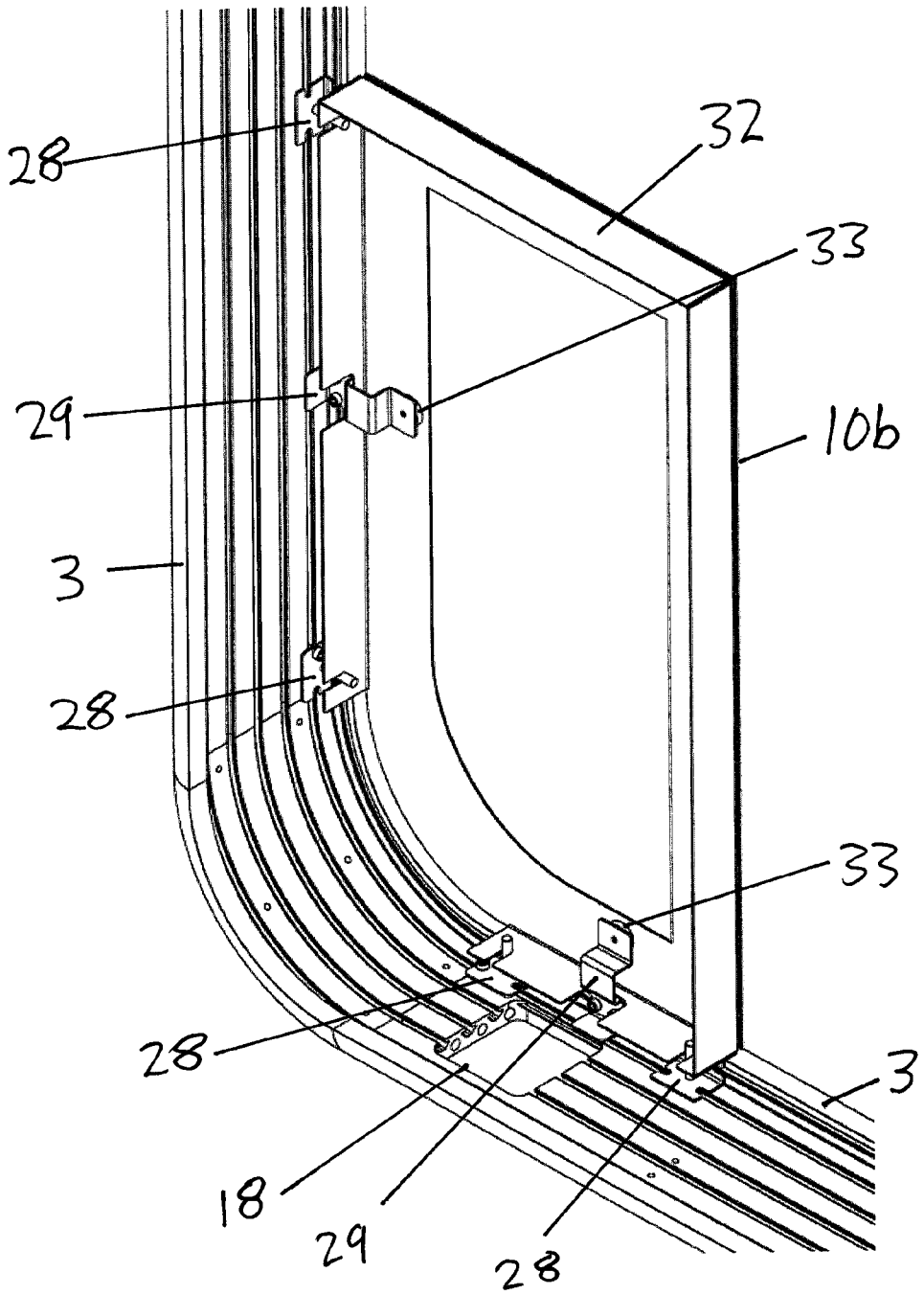

FIG. 5 as a perspective view of a straight extruded section of the peripheral frame of the display units of FIGS. 1 to 4;

FIG. 6 is a plan view of a corner section of a peripheral frame of the display units of FIGS. 1 to 4;

FIG. 7 is a perspective view of the corner section of FIG. 6;

FIG. 8 is a second perspective view of the corner section of FIGS. 6 and 7;

FIG. 9 is a perspective view of the corner sections of FIGS. 6 to 8 with a corner plate attached thereto;

FIG. 10 is a perspective view showing two straight sections and a corner section of a peripheral frame of the display units of FIGS. 1 to 4 connected together and supporting additional internal frame components;

FIG. 11 shows the corner section of FIGS. 6 to 8 attached to two straight sections of FIG. 5 by a turnbuckle;

FIG. 12 shows how a speaker housing and speaker panel may be attached to the straight extruded section of FIG. 5; and FIG. 13 illustrates how a front glass panel may be attached by means of a back box to the peripheral frame of the display units of FIGS. 1 to 4.

Figure 1:
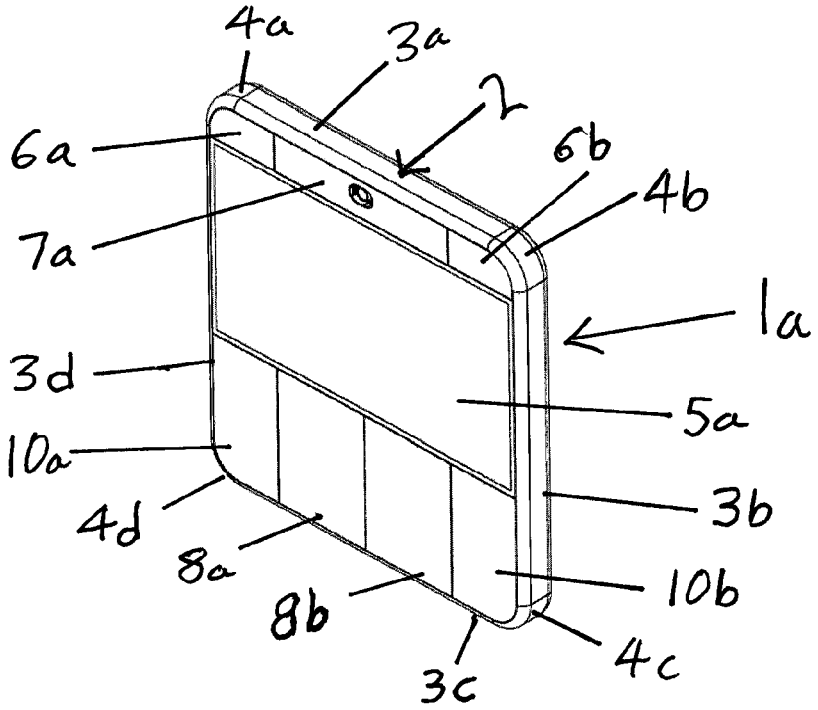
FIG. 1 illustrates a single screen display unit in accordance with the present invention.
Figure 2:
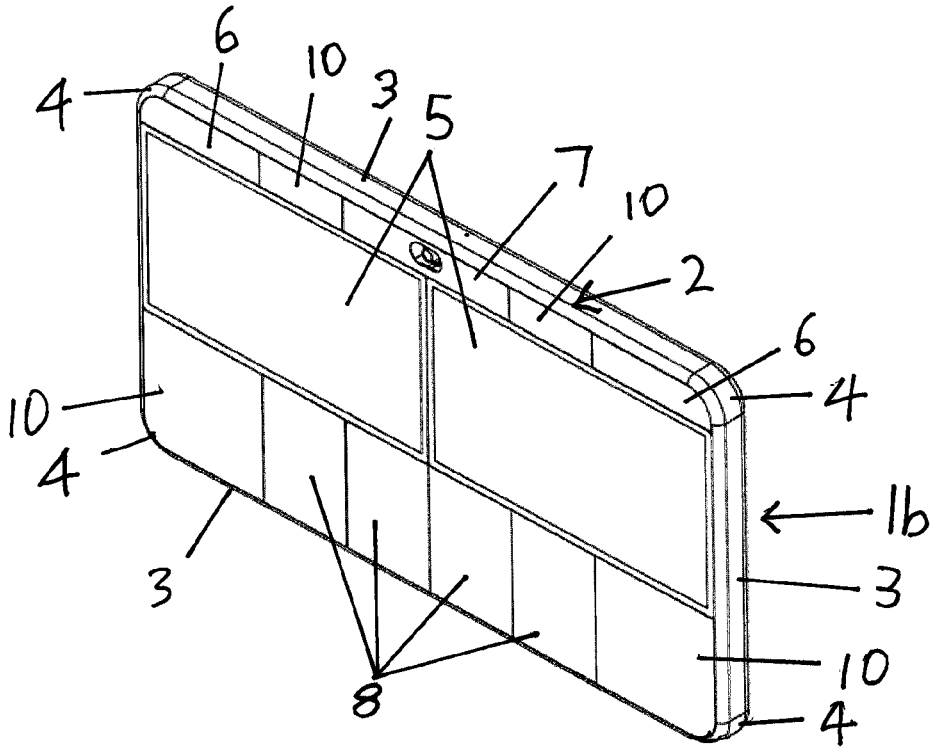
FIG. 2 illustrates a dual screen display unit in accordance with the present invention.
Figure 3:
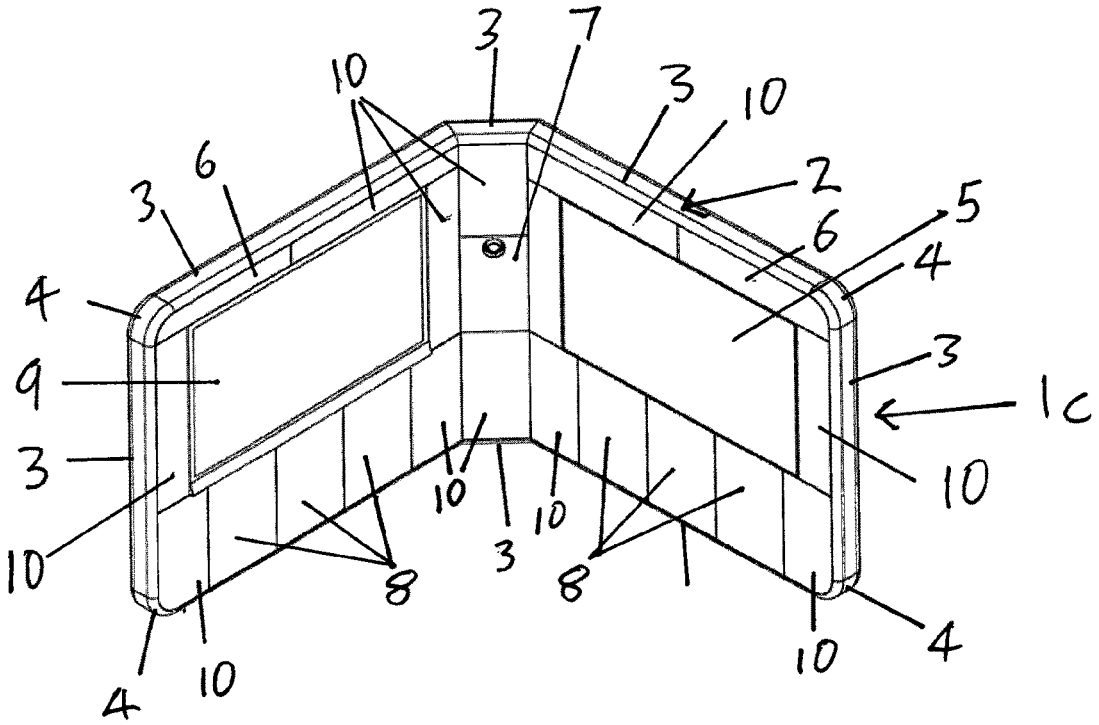
FIG. 3 illustrates an alternative dual screen unit in accordance with the present invention.
Figure 4:
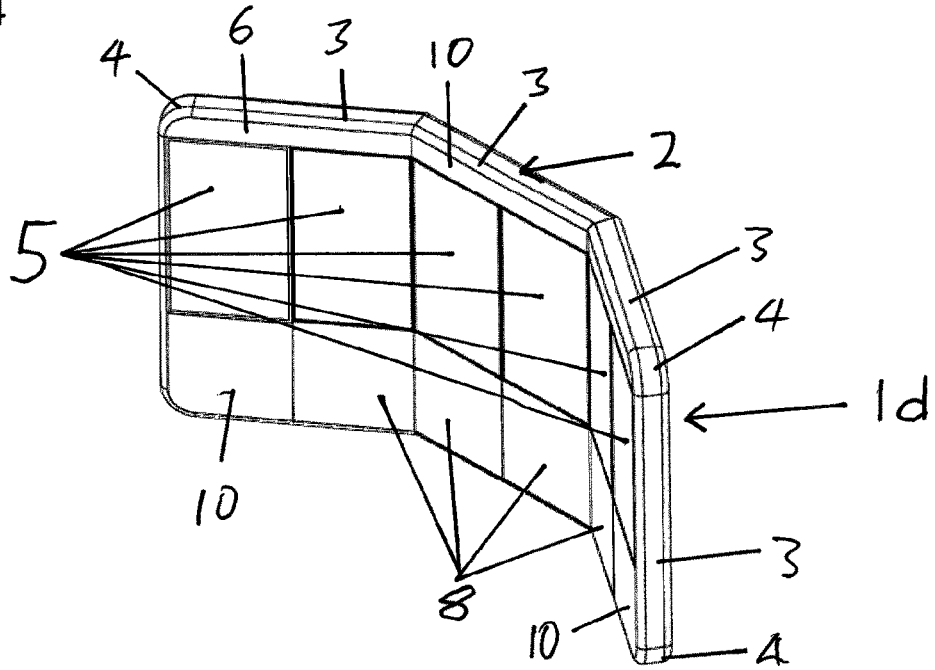
FIG. 4 illustrates a six screen display unit in accordance with the present invention.

Referring now to FIG. 1, there is illustrated a single screen display unit, indicated generally as 1*a*, in accordance with the present invention. This comprises an outer peripheral frame 2 made up of four straight extruded sections 3*a* to 3*d* and four curved extruded sections 4*a* to 4*d*.

In the peripheral frame 2 there is mounted a single flat panel display 5*a*, two speaker panels 6*a* and 6*b*, a camera panel 7*a*, two drop forward storage pins 8*a* and 8*b* for receiving electrical equipment such as computers and communications equipment associated with the display unit 1*a* and two glass blanking panels 10*a* and 10*b*.

As will be appreciated from a review of FIGS. 1 to 4, the various display units 1*b* to 1*d* are similar to that of FIG. 1*a*, each comprising at least one flat panel display 5, a peripheral frame 2 made up of straight extruded sections 3, (in the case of display units 1*c* and 1*d* some of these are appropriately mitred to abut against adjoining straight extruded sections) a number of curved extruded sections 4 forming corners of the peripheral frames 2, blanking panels 10, a camera panel 7, speaker panels 6 and drop forward rack mount pods 8.

The different display units 1*a* to 1*d*, of FIGS. 1 to 4, may be constructed from at least some common components, such as mountings, curved extruded sections 4, flat panel displays 5, speaker panel 6, drop forward rack mount pods 8 and glass blanking panels 10. Also lengths of straight extruded sections may be cut to length to form the straight extruded sections of the peripheral frames of different display units 1*a* to 1*d*.

Referring now to FIG. 5, here there is shown in perspective view of a straight extruded section 3 of the peripheral frame 2 of the display units 1*a* to 1*d*. The straight extruded section 3 is extruded from aluminium, but could be extruded from another metal or from a hard plastic.

The straight extruded section 3 comprises base portion 11 and two side portions 12 and 13, such that in profile the straight extruded section 3 is substantially U-shaped with a smooth outer face 14 and an inner face 15.

The extrusion profile is such that a number of channels 16*a* to 16*g* are defined in the inner face 15, both in the base portion 11 and in each side portion 12 and 13, each channel 16*a* to 16*g* having a narrow neck portion.

The straight extruded section 3 also has a number of circular openings 17 running through it.

The straight extruded section 3 illustrated in FIG. 5 is intended to be used as a bottom section of the peripheral frame 2 of one of the display units 1*a* to 1*d* and has an aperture 18 machined in it to provide an access for cabling into the display unit. Also mountings 29 and 30 are shown fixed to the straight extruded section 3 by T-slot nuts in appropriate ones of the channels 16*a* to 16*g*. These mountings 28 and 29 are described in greater detail below, with reference to FIGS. 12 and 13.

Referring to FIGS. 6 to 8, these illustrate various views of a curved extruded section 4 used to form the corners of the display units 1*a* to 1*d*. The curved extruded section 4 is formed from the same extrusion as that illustrated in FIG. 3, but this has been cut to an appropriate length and subsequently curved. However, these could be manufactured by a different process, particularly they could be diecast.

The curved extruded sections 4 have the same cross section profile as the straight extruded section illustrated in FIG. 5 and the circular openings 17 may be used to accept dowels (not shown) to align adjacent straight and curved extruded sections (3, 4). Additionally the curved extruded section 4 has a number of holes 19 on an inner face thereof which, as seen in FIG. 9, may be used to mount a corner plate 20 to an inner face of the curved extruded section 4, by means of fastenings 21.

Referring now to FIG. 10, this shows a section of the peripheral frame 2 of the display unit 1*a* of FIG. 1, comprising two straight extruded sections 3*c* and 3*d* joined together by curved extruded section 4*d* having corner plate 20 secured to an inner face thereof. As previously described, but not seen in FIG. 10, dowels are inserted in the circular openings 17 of the curved extruded section 4*d*, which dowels engage with corresponding circular opening 17 in the straight extruded sections 3*c* and 3*d*. Also the corner plate 20 extends over the inner faces 15 of respective straight extruded sections 3*c* and 3*d* and may be fixed thereto, if desired, by means of fastenings engaging with T-slot nuts pre-inserted and captive in appropriate ones of channels 16*b* to 16*f*. Identical captive T-slot nuts in channels 16*d* and 16*c* of both the straight extruded sections 3*c* and 3*d* may be used to a secure brace member 22.

As also seen from FIG. 10 extruded internal frame members 23 and 24 may also be fixed and supported by the peripheral frame 2 and these may be attached in substantially any location by fastening them to appropriate T-slot nuts in an appropriate channel 16*a* to 16*f* at any desired location. In this manner an internal frame may be constructed to support the components mounted within the peripheral frame.

Referring now to FIG. 11, this shows an alternative arrangement, where brace member 22 is attached by turnbuckle 25 to the corner plate 20 and thus to the curved extruded section 4. It will be appreciated that in this arrangement, tensioning of the turnbuckle pulls the corner section 4 into engagement with the straight extruded sections 3*a* and 3*b*, the adjacent sections of the peripheral frame 2 being retained in alignment by means of the dowels (not shown).

As will now be illustrated with reference to FIGS. 12 and 13 the channels 16*a* to 16*g*, (which as shown in FIG. 13 may extend around the complete inner face of the peripheral frame 2), may be used to anchor mountings 26 to 29 for various components of the display units 1*a* to 1*d*.

Referring to FIG. 12, this shows mountings 26, in the form of a location pins, being used to correctly locate a backing box 30 for a speaker panel 6*a*. Mounting 27 is used to mount speaker housing 31 and an associated speaker (not shown) behind the speaker panel 6*a*. Similarly, in FIG. 13, mountings 28 are used to correctly position a backing box 32 of a glass blanking panel 10*b* of the display unit 1*a* of FIG. 1. The backing box 32 is retained in place by means of magnets 33 on mountings 29.

As will be appreciated from FIGS. 12 and 13, a number of standard mountings may be used to mount different components of the display unit in any of a number of required locations, by the mountings being secured to one or more of the channels 16*a* to 16*g* at an appropriate location.

The invention has been described above, by way of example only, with reference to the accompanying Figures. However, it will be appreciated that many modifications may be made without departing from the scope of the invention as defined by the following claims.

The invention claimed is:

1. A display unit comprising one or more display panels and a peripheral frame in which the one or more display panels are mounted and by which the one or more display panels are supported, wherein the peripheral frame comprises a plurality of straight extruded sections and a plurality of corner sections linking the straight extruded sections together to form the peripheral frame, each straight extruded section having a substantially solid body defining a substantially flat and inflexible inward facing surface, in which surface a plurality of transversely spaced extruded channels are formed running longitudinally in a length direction of the straight extruded section, each channel in profile having a narrow neck portion and a wider main portion below the neck portion, the display unit further comprising a plurality of channel engaging members each arranged to be slotted into any one of the extruded channels to permit each channel engaging members to be placed in any desired transversely spaced channel and to slide along that channel to a desired longitudinal position, to anchor a mounting for a component of the display unit against the substantially flat and inflexible inward facing surface at one or more transverse locations.

2. The display unit as claimed in claim 1 wherein a transverse profile of each straight extruded section is symmetrical about a longitudinal central plane of the extruded section.

3. The display unit as claimed in claim 1 wherein adjacent extruded channels in the inward facing surface are equally spaced.

4. The display unit as claimed in claim 1 wherein each straight extruded section has a substantially U-shaped cross sectional profile, with a substantially flat base portion and two side portions.

5. The display unit as claimed in claim 1 wherein at least an inner face of at least one side portion has at least one channel therein.

6. The display unit as claimed in claim 1 wherein each corner section has a cross sectional profile having channels corresponding to the channels in the straight extruded sections, which channels are in register with the channels in the straight extruded sections when the peripheral frame is assembled.

7. The display unit as claimed in claim 1 further comprising at least one dowel engaging at least one said of straight extruded sections and an adjacent one of said corner sections.

8. The display unit as claimed in claim 1 wherein the straight extruded sections and corner sections in cross section have a plurality of corresponding sets of holes for receiving respective dowels when the peripheral frame is assembled.

9. The display unit as claimed in claim 1 wherein the channel engaging members are T-slot nuts.

10. The display unit as claimed in claim 1 wherein the plurality of straight extruded sections and the plurality of corner sections are metal.

11. The display unit as claimed in claim 10 wherein the unit comprises at least two planar sections are angled relative to each other and wherein the peripheral frame is continuous about all planar sections of the at least two planar sections.

12. The display unit as claimed in claim 11 comprising two adjacent straight extruded sections of the peripheral frame which are mitred where the two respective planar sections meet.

13. The display unit as claimed in claim 1 wherein the peripheral frame comprises four right angled corner sections and four extruded straight sections.

14. The display unit as claimed in claim 1 wherein the unit comprises at least one planar section with parallel front and rear faces, wherein the peripheral frame forms a continuous edge around the planar section.

15. The display unit as claimed in claim 1 comprising a plurality of components of different types to be housed in and supported by said peripheral frame and a plurality of different types of mounting arranged to engage with the channel engaging members in appropriate channels and at appropriate portions along the channels to permit the different component types to be correctly located.

16. The display unit as claimed in claim 1 further comprising a plurality of internal frame members for supporting the one or more display panels within the peripheral frame, each internal frame member being arranged to be supported by and retained in place by the peripheral frame and arranged to engage, via appropriate mounting, with the channels in the peripheral frame.

17. The display unit as claimed in claim 16 wherein the internal frame members are extruded and have extruded channels having the same cross section profile as the extruded channels in the straight extruded sections of the peripheral frame.

18. The display unit as claimed in claim 1 comprising a plurality of different types of components to be mounted in the display unit and a plurality of identical mountings arranged to engage with the channel engaging members to provide mounting for respective ones of the plurality of different types of components.

* * * * *